US010557694B1

(12) United States Patent
Wurzel et al.

(10) Patent No.: US 10,557,694 B1
(45) Date of Patent: Feb. 11, 2020

(54) SEAL FOR A PROJECTILE GUIDING KIT AND METHOD OF ASSEMBLING AND OPERATION

(71) Applicant: BAE Systems Rokar International Ltd., Jerusalem (IL)

(72) Inventors: Gil Wurzel, Maas (IL); Tsafrir Keynan, Modiin (IL); Ziv Moshkovitz, Elin-Ayala (IL)

(73) Assignee: BAE SYSTEMS ROKAR INTERNATIONAL LTD, Jerusalem (IL)

( * ) Notice: Subject to any disclaimer, the term of this patent is extended or adjusted under 35 U.S.C. 154(b) by 0 days.

(21) Appl. No.: 16/535,385

(22) Filed: Aug. 8, 2019

(30) Foreign Application Priority Data

Feb. 7, 2019 (IL) ..... 264739

(51) Int. Cl.

| | |
|---|---|
| ***F42B 15/01*** | (2006.01) |
| ***F42B 10/26*** | (2006.01) |
| ***F42B 12/02*** | (2006.01) |
| *F42B 15/00* | (2006.01) |

(52) U.S. Cl.
CPC ..... *F42B 10/26* (2013.01); *F42B 12/02* (2013.01); *F42B 15/00* (2013.01)

(58) Field of Classification Search
CPC ..... F42B 10/62; F42B 10/64
See application file for complete search history.

(56) References Cited

U.S. PATENT DOCUMENTS

| | | | | |
|---|---|---|---|---|
| 8,069,790 | B1 * | 12/2011 | Melkers | F42B 15/36 102/275.9 |
| 2008/0315032 | A1 * | 12/2008 | Harnoy | F42B 10/26 244/3.23 |
| 2012/0048992 | A1 * | 3/2012 | Malul | F42B 10/64 244/3.24 |
| 2015/0247715 | A1 * | 9/2015 | Wurzel | F42B 10/64 244/3.23 |

* cited by examiner

*Primary Examiner* — J. Woodrow Eldred
(74) *Attorney, Agent, or Firm* — Pearl Cohen Zedek Latzer Baratz LLP

(57) ABSTRACT

A device for sealing a projectile guiding kit may be used with any kit having a rear unit and a front unit rotatably connectable to the rear unit thereof. The device may include an annular body adapted to envelope at least a front portion of the rear unit and at least a rear portion of the front unit of the kit. The device may include a flexible ring-shaped strip attached to an inner side and at a front end of the annular body and adapted to seal a gap between the rear unit and the front unit of the kit. The annular body may be adapted to slide towards the rear unit of the kit when subjected to a longitudinal acceleration that exceeds a predetermined acceleration value, thereby uncovering the gap and enabling uninterrupted rotation of the front unit with respect to the rear unit of the kit.

14 Claims, 10 Drawing Sheets

Cross-section AA':

100

Cross-section BB':

SEAL FOR A PROJECTILE GUIDING KIT AND METHOD OF ASSEMBLING AND OPERATION

CROSS REFERENCE TO RELATED APPLICATIONS

This application claims the benefit of Israeli Patent Application Serial No. 264739, filed on Feb. 7, 2019, which is incorporated herein by reference in its entirety.

FIELD OF THE INVENTION

The present invention relates to the field of projectile guiding kits, and more particularly, to sealings for the projectile guiding kits.

BACKGROUND OF THE INVENTION

Some current projectile guiding kits include a rear unit adapted to be connected at its rear end to a front end of a projectile and a front unit rotatably connected at its rear end to a front end of the rear unit. Typically, there is a small gap between the rear unit and the front unit to ensure uninterrupted relative rotation of the front unit with respect to the rear unit. These guiding kits typically include one or more bearings assembly positioned in, or proximal to, the gap between the rear unit and the front unit to enable the rotation of the front unit with respect to the rear unit.

In order to ensure proper operation of these guiding kits upon firing of the projectile, it is necessary to prevent dust and/or dirt from entering the gap and dirtying the bearing(s). Accordingly, these guiding kits typically include a cover that is adapted to cover the gap between the rear unit and the front unit of the kit while the projectile is not in use.

Typically, the coverings thereof have to be manually removed from the kit, for example prior to feeding the projectile into a firing chamber of a weapon. This operation may be time consuming (especially when large number of projectiles or fast firing are needed) and/or may prevent using such projectile guiding kits with projectiles for automatic weapons. Furthermore, dust and dirt accumulated within the firing chamber of the weapon may also enter the gap and dirt the bearing(s) of the guiding kit.

Accordingly, there is a need in a device for sealing projectile guiding kits during the entire life time of the kit prior to the commencing of the relative rotation following the actual firing of the projectile.

SUMMARY OF THE INVENTION

One aspect of the present invention provides a device for sealing a projectile guiding kit having a rear unit adapted to be connected at its rear end to a front end of a projectile and a front unit rotatably connectable at its rear end to a front end of the rear unit, the device may include: an annular body adapted to envelope at least a front portion of the rear unit and at least a rear portion of the front unit of the guiding kit; and a flexible ring-shaped strip attached to an inner side and close to a front end of the annular body, the ring-shaped strip being adapted to seal a gap between the rear unit and the front unit of the guiding kit at a connection region therebetween; wherein the annular body is adapted to slide towards the rear unit of the guiding kit when subjected to a longitudinal acceleration that exceeds a predetermined acceleration value, thereby uncovering the gap and enabling uninterrupted rotation of the front unit with respect to the rear unit of the guiding kit.

In some embodiments, the device further includes a trapping unit adapted to be connected to the rear unit of the guiding kit and adapted to do at least one of: support at least a rear end of the annular body to prevent unintended sliding of the annular body towards the rear unit of the guiding kit; and lock the annular body of the device with respect to the rear unit of the guiding kit upon sliding of the annular body thereto.

In some embodiments, the trapping unit includes an annular plate adapted to be connected to the rear end of the rear unit of the guiding kit and includes at least one first protrusion that protrudes outwards from the annular plate and is arranged to support the rear end of the annular body and to prevent the unintended sliding of the annular body.

In some embodiments, the trapping unit includes an annular plate adapted to be connected to the rear end of the rear unit of the guiding kit and includes at least one second protrusion that protrudes outwards from the annular plate, wherein the annular body includes an indent along at least a portion of a circumference of the inner side of the annular body between the ring-shaped strip and the rear end of the annular body, and wherein the at least one second protrusion of the trapping unit is adapted to enter into the indent of the annular body to thereby lock the annular body with respect to the rear unit of the guiding kit upon sliding of the annular body thereto.

In some embodiments, the device includes at least one front stopper adapted to be connected to the front unit of the guiding kit and adapted to prevent unintentional sliding of the annular body towards the front unit of the guiding kit.

In some embodiments, a portion of the inner side of the annular body that is adjacent to a rear end of the annular body is tapered in a direction extending from the rear end to the front end of the annular body and adapted to rest on corresponding portion of a projectile upon sliding of the annular body thereto.

In some embodiments, an outer side of the annular body is tapered in a direction extending from a rear end to the front end of the annular body.

Another aspect of the present invention provides a projectile guiding kit adapted to be connected to a projectile, the kit may include: a rear unit adapted to be connected at its rear end to a front end of the projectile; a front unit rotatably connected at its rear end to a front end of the rear unit; an annular body adapted to envelope at least a front portion of the rear unit and at least a rear portion of the front unit; and a flexible ring-shaped strip attached to an inner side and close to a front end of the annular body, the ring-shaped strip being adapted to seal a gap between the rear unit and the front unit at a connection region therebetween; wherein the annular body is adapted to slide towards the rear unit of the guiding kit when subjected to a longitudinal acceleration that exceeds a predetermined acceleration value, thereby uncovering the gap and enabling uninterrupted rotation of the front unit with respect to the rear unit.

In some embodiments, the projectile guiding kit further includes a trapping unit adapted to be connected to the rear unit and adapted to at least one of: support at least a rear end of the annular body to prevent unintended sliding of the annular body towards the rear unit; and lock the annular body with respect to the rear unit upon sliding of the annular body thereto.

In some embodiments, the trapping unit includes an annular plate adapted to be connected to the rear end of the rear unit of and includes at least one first protrusion that protrudes outwards from the annular plate and is arranged to support the rear end of the annular body and to prevent the unintended sliding of the annular body.

In some embodiments, the trapping unit includes an annular plate adapted to be connected to the rear end of the rear unit and includes at least one second protrusion that protrudes outwards from the annular plate, wherein the annular body includes an indent along at least a portion of a circumference of the inner side of the annular body between the ring-shaped strip and the rear end of the annular body, and wherein the at least one protrusion of the trapping unit is adapted to enter into the ident of the annular body to thereby lock the annular body with respect to the rear unit upon sliding of the annular body thereto.

In some embodiments, the front unit includes at least one front stopper adapted to prevent unintentional sliding of the annular body towards the front unit.

In some embodiments, a portion of the inner side of the annular body that is adjacent to a rear end of the annular body is tapered in a direction extending from the rear end to the front end of the annular body and adapted to rest on corresponding portion of a projectile upon sliding of the annular body thereto.

In some embodiments, an outer side of the annular body is tapered in a direction extending from a rear end to the front end of the annular body.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same can be carried into effect, reference will now be made, purely by way of example, to the accompanying drawings in which like numerals designate corresponding elements or sections throughout.

In the accompanying drawings.

Figure 1A:
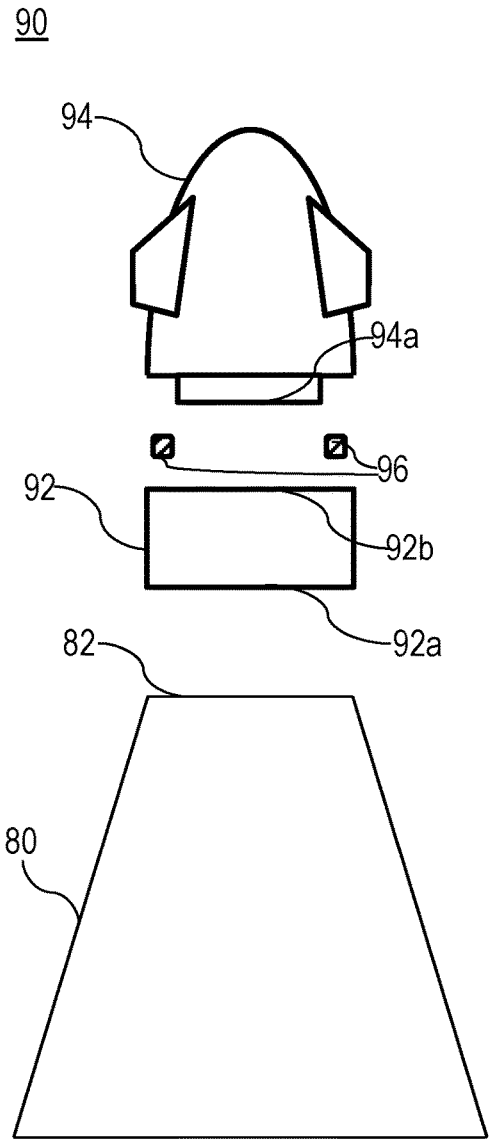
PRIOR ART Fig. 1A
FIGS. 1A and 1B are schematic illustrations of a projectile guiding kit for a projectile.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following description, various aspects of the present invention are described. For purposes of explanation, specific configurations and details are set forth in order to provide a thorough understanding of the present invention. However, it will also be apparent to one skilled in the art that the present invention can be practiced without the specific details presented herein. Furthermore, well known features can have been omitted or simplified in order not to obscure the present invention. With specific reference to the drawings, it is stressed that the particulars shown are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention can be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments that can be practiced or carried out in various ways as well as to combinations of the disclosed embodiments. Also, it is to be understood that the phraseology and terminology employed herein is for the purpose of description and should not be regarded as limiting.

The terms "front" and "rear" as used herein represent orientation of the disclosed devices/kits with respect to a projectile to be used with, and specifically, these relative directions/locations relate to the direction of flight of the projectile, when fired, as "forward".

Generally, a device for sealing a projectile guiding kit is disclosed. Some projectile guiding kits may include a rear unit adapted to be connected at its rear end to a front end of a projectile and a front unit rotatably connected at its rear end to a front end of the rear unit. The kits may include one or more bearings positioned in, or proximal to, a gap between the rear unit and the front unit to enable the rotation of the front unit with respect to the rear unit.

The disclosed device may be adapted to seal the gap between the rear unit and the front unit of the projectile guiding kit for the entire life time of the guiding kit/projectile prior to actual firing of the projectile. The device may be adapted to slide towards the rear unit of the guiding kit upon firing of the projectile, when the device is subjected to a longitudinal acceleration that exceeds a predetermined acceleration value and/or when subjected to a longitudinal aerodynamic force that exceeds a predetermined longitudinal force value. The sliding thereof may uncover the gap between the rear unit and the front unit of the guiding kit, thereby enabling uninterrupted rotation of the front unit with respect to the rear unit according to the aerodynamic forces applied thereon and provide proper operation of the kit thereof.

Advantageously, the disclosed device need not be removed from the guiding kit prior to firing of the projectile. For example, the projectile may be fed into a firing chamber of a weapon without detaching/releasing the device from the guiding kit. Accordingly, the disclosed device may seal sensitive elements of the projectile guiding kit (such as bearing(s) between the rear unit and the front unit thereof) all the way up to actual firing of the projectile. Furthermore, the disclosed device may save time and reduce personnel's effort required to prepare the projectile for firing and/or enable usage of the guiding kit with projectiles in automatic weapons. This is in contrast to current covering for the projectile guiding kit that has to be manually released/detached from the guiding kit prior to feeding the projectile into the weapon's firing chamber.

Figure 1B:
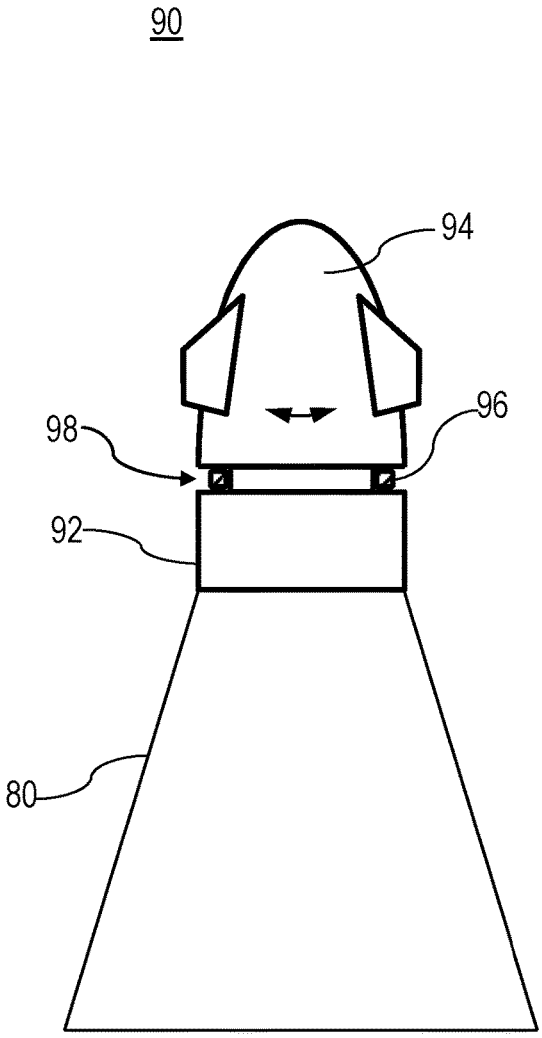
PRIOR ART Fig. 1B

Reference is now made to FIGS. 1A and 1B, which are schematic illustrations of a projectile guiding kit 90 for a projectile 80. FIG. 1A shows and exploded side view and FIG. 1B shows an assembled side view of guiding kit 90.

Projectile guiding kit 90 may have a rear unit 92 adapted to be connected at its rear end 92*a* to a front end 82 of a projectile 80 and a front unit 94 rotatably connected at its rear end 94*a* to a front end 92*b* of rear unit 92. Projectile guiding kit 90 may have one or more bearings 96 positioned within, or proximal to, a gap 98 between rear unit 92 and front unit 94 to enable the rotation of front unit 94 with respect to rear unit 92.

Reference is now made to FIGS. 2A, 2B, 2C and 2D, which are schematic illustrations of a device 100 for sealing a projectile guiding kit 90, according to some embodiments of the invention. Reference is also made to FIG. 2E, which is a schematic illustration of a projectile guiding kit 90 and device 100 for sealing projectile guiding kit 90, according to some embodiments of the invention. Reference is also made to FIG. 2F, which is a schematic illustration of a projectile guiding kit 90 and a device 100 for sealing projectile guiding kit 90, prior to and after firing of a projectile 80, according to some embodiments of the invention.

Figure 2A:
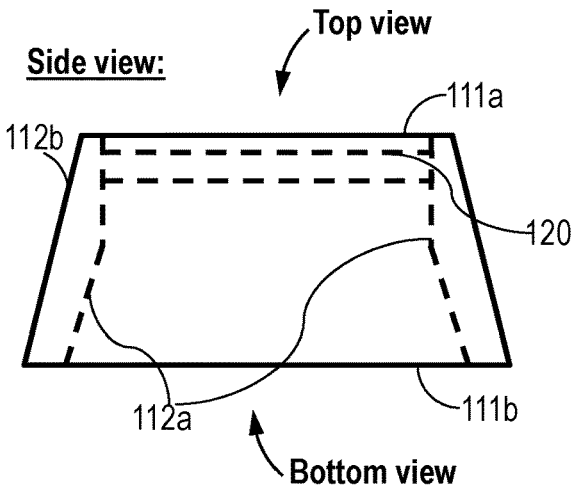
FIGS. 2A, 2B, 2C and 2D are schematic illustrations of a device for sealing a projectile guiding kit, according to some embodiments of the invention.
Figure 2B:
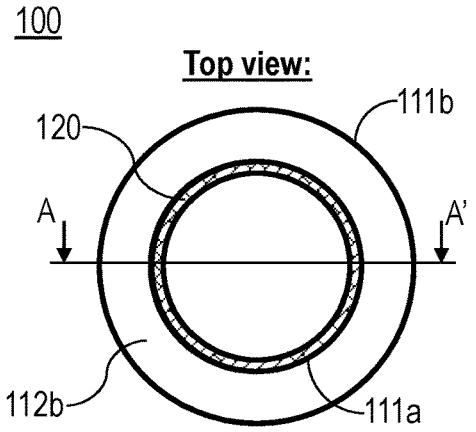
Figure 2C:
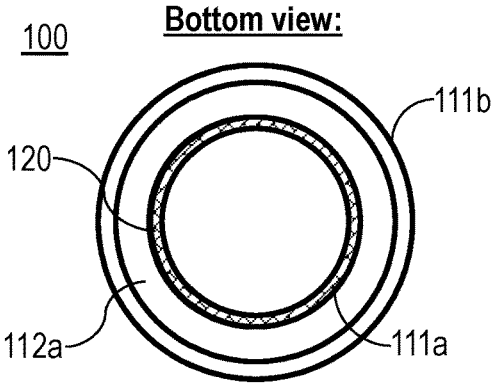
Figure 2D:
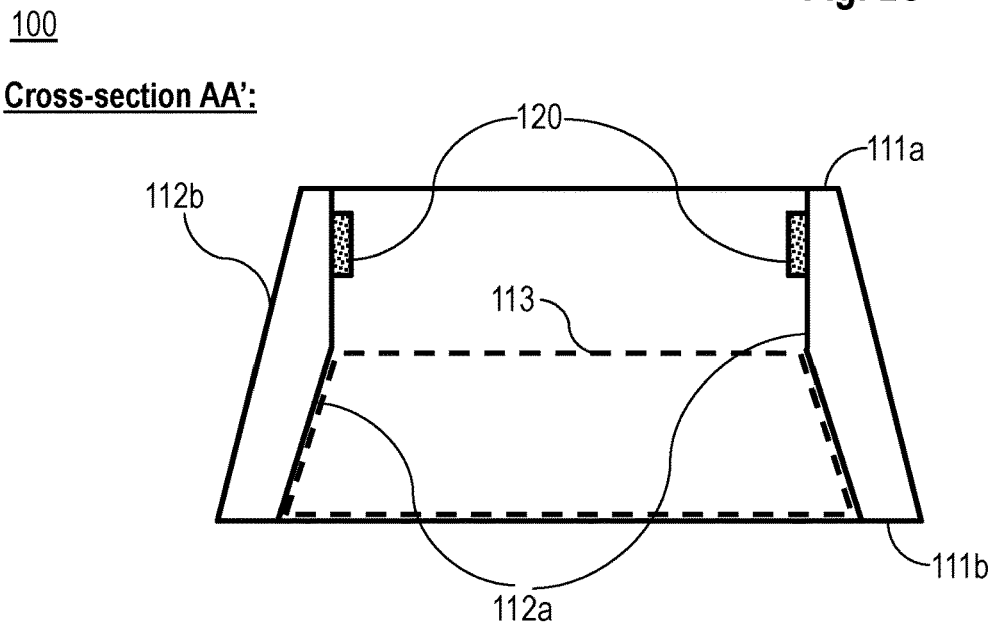
Figure 2E:
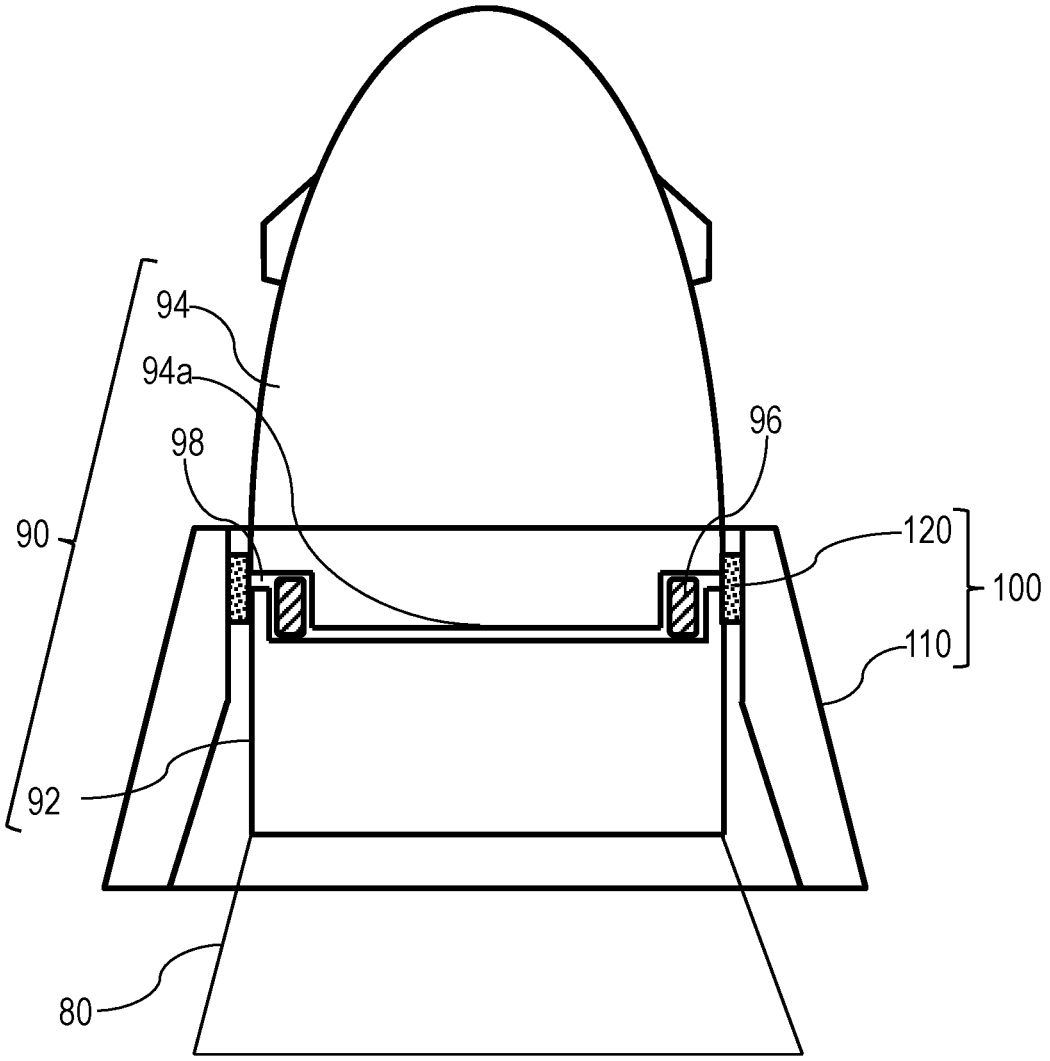
FIG. 2E is a schematic illustration of a projectile guiding kit and a device for sealing the projectile guiding kit, according to some embodiments of the invention.
Figure 2F:
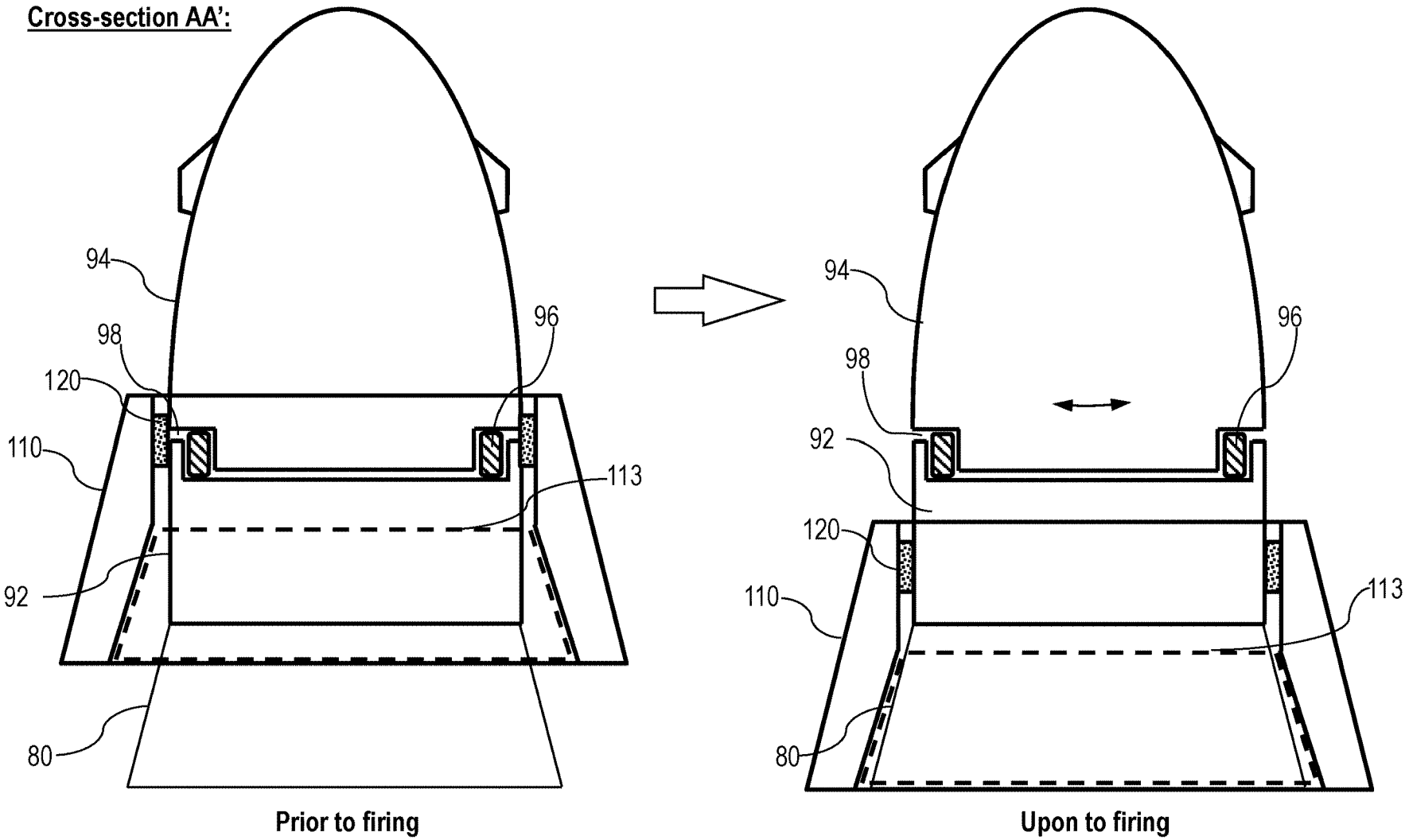
FIG. 2F is a schematic illustration of a projectile guiding kit and a device for sealing the projectile guiding kit, prior to and after firing of a projectile, according to some embodiments of the invention.

FIG. 2A shows a side view, FIG. 2B shows a top view, FIG. 2C shows a bottom view, and FIG. 2D shows a cross-sectional view of device 100. FIGS. 2E and 2F show cross-sectional views of device 100 and of projectile guiding kit 90.

According to some embodiments, device 100 may be used with any projectile guiding kit having two or more rotatably connectable units. For example, device 100 may be used with projectile guiding kit 90 described above with respect to FIGS. 1A and 1B.

Device 100 may include an annular (or substantially annular) body 110. Annular body 110 may have a front end 111*a*, a rear end 111*b*, an inner side 112*a* and an outer side 112*b* (e.g., as shown in FIG. 2A).

Device 100 may have a flexible ring-shape strip 120. Ring-shape strip 120 may be attached to annular body 110 at inner side 112*a* and either adjacent or close to front end 111*a* of annular body 110 (e.g., as shown in FIGS. 2A and 2D). In some embodiments, ring-shape strip 120 is attached to annular body 110 along the entire circumference of inner side 112*a* of annular body 110 (e.g., as shown in FIGS. 2B and 2C). In some embodiments, flexible ring-shape strip 120 may be made of a rubber.

According to some embodiments, annular body 110 of device 100 may be adapted to envelope at least a front portion of rear unit 92 and at least a rear portion of front unit 94 of projectile guiding kit 90. For example, annular body 110 may be adapted to envelope the entire (or substantially entire) rear unit 92 and a portion of front unit 94 of guiding kit 90 that is adjacent to rear end 94*a* of front unit 94 (e.g., as shown in FIG. 2E). Device 100 may be retrofit onto existing projectile guiding kits (e.g., such as guiding kit 90, as shown in FIG. 2E).

Ring-shaped strip 120 may be adapted to tightly seal gap 98 between rear unit 92 and front unit 94 when device 100 is used with guiding kit 90. For example, FIG. 2E shows ring-shape strip 120 sealing gap 98 when annular body 110 envelopes respective portions of rear unit 92 and front unit 94.

Annular body 110 of device 100 may be adapted to slide towards rear unit 92 of guiding kit 90 when subjected to a longitudinal acceleration that exceeds a predetermined acceleration value and/or when subjected to a longitudinal aerodynamic force that exceeds a predetermined longitudinal force value. In some embodiments, the predetermined acceleration value is no less than 1000G. In some embodiments, the predetermined longitudinal force value is no less than 100 N.

For example, FIG. 2F illustrates sliding of annular body 110 towards rear unit 92 of guiding kit 90 upon firing of projectile 80. The sliding of annular body 110 may uncover gap 98 (e.g., that may be sealed by flexible ring-shape strip 210 prior to firing), thereby enabling uninterrupted rotation of front unit 94 of guiding kit 90 with respect to rear unit 92 thereof.

Upon firing of projectile 80 and during the flight of projectile 80, aerodynamic forces applied on annular body 110 of device 100 may push annular body 110 towards rear unit 92 of guiding kit 90, thereby ensuring that gap 98 between rear unit 92 and front unit 94 thereof remains uncovered, so to enable uninterrupted rotation of front unit 94 with respect to rear unit 92.

In some embodiments, annular body 110 of device 100 is adapted to slide and rest on projectile 80 upon firing thereof. In these embodiments, a portion 113 of inner side 112*a* that is adjacent to rear end 111*b* of annular body 110 may be adapted in shape and size to receive corresponding portion of projectile 80 (e.g., as shown in FIGS. 2D and 2F). For example, portion 113 may be tapered in a direction extending from rear end 111*b* towards front end 111*a* of annular body 110.

In some embodiments, outer side 112*b* of annular body 130 is tapered in the direction extending from rear end 111*b* towards front end 111*a* of annular body 110 (e.g., as shown in FIGS. 2A, 2D and 2F). The tapered shape thereof may be designed to ensure that annular body 110 does not affect (or substantially does not affect) the aerodynamic parameters of projectile 80 and/or of guiding kit 90.

According to various embodiments, mechanical parameters of device 100 (e.g., of annular body 110 and/or of flexible ring-shape strip 120) are determined to prevent unintended sliding of annular body 110 prior to firing of projectile 80 and also to enable sliding of annular body 110 toward rear unit 92 of guiding kit 90 upon firing of projectile 80 (e.g., as shown in FIG. 2F). The mechanical parameters may, for example, include dimensions, material and/or mechanical properties of annular body 110 and/or of flexible ring-shape strip 120.

For example, dimensions of annular body 110 and/or of flexible ring-shape strip 120 and/or mechanical properties of flexible ring-shape strip 120 may be determined so as to provide a desired friction force between flexible ring-shape strip 120 and the respective portions of rear unit 92 and front unit 94 of guiding kit 90. In some embodiments, the desired friction force may be no less than 10-50 N.

In this manner, annular body 110 may provide sealing of gap 98 between rear unit 92 and front unit 94 of guiding kit 90 during the entire life time of projectile 80 prior to actual firing thereof without disturbing the operation of guiding kit 90 upon firing and during the flight of projectile 80.

It is noted that, for simplicity and clarity of illustration, elements shown in FIGS. 2A-2F have not necessarily been drawn to scale. It is further noted that the shape and dimensions of device 100 and/or annular body 110 are determined to ensure that device 100 and/or annular body 110 does not affect (or substantially does not affect) the aerodynamic forces applied on and/or the aerodynamic parameters of guiding kit 90 and/or on projectile 80 during flight of projectile 80.

Reference is now made to FIGS. 3A, 3B, 3C and 3D, which are schematic illustrations of a device 100 for sealing a projectile guiding kit 90 and including a trapping unit 140 and at least one front stopper 150, according to some embodiments of the invention. Reference is also made to FIGS. 3E and 3F, which are schematic illustrations of a projectile guiding kit 90 and a device 100 for sealing projectile guiding kit 90, and including a trapping unit 140 and at least one front stopper 150, according to some embodiments of the invention. Reference is also made to FIG. 3G, which is a schematic illustration of a device 100 for sealing a projectile guiding kit 90 and including a trapping unit 140 and at least one front stopper 150, prior to and after firing of a projectile 80, according to some embodiments of the invention.

Figure 3A:
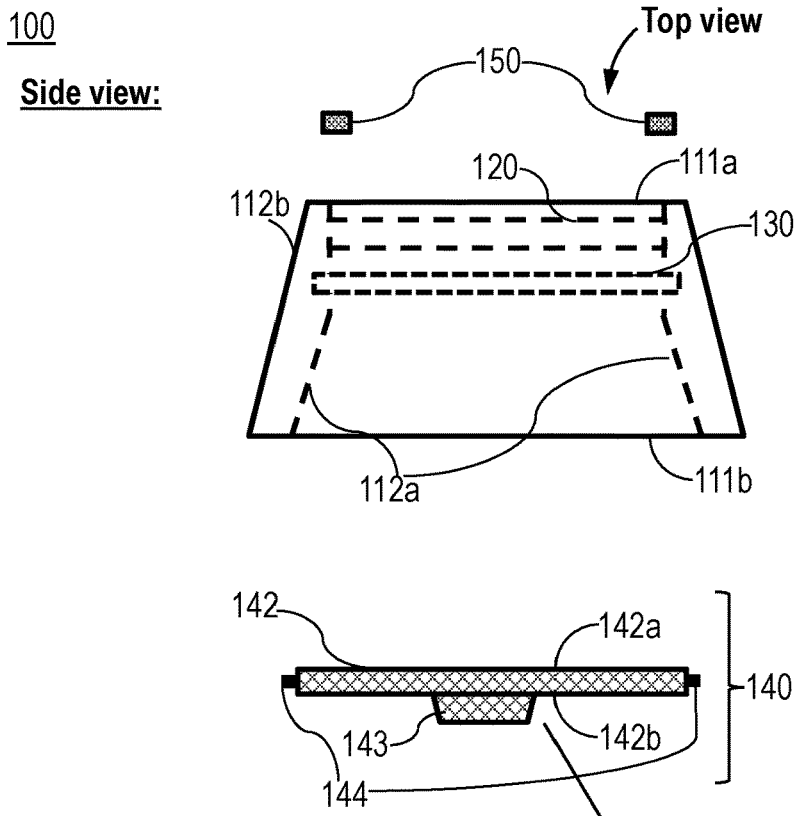
FIGS. 3A, 3B, 3C and 3D are schematic illustrations of a device for sealing a projectile guiding kit and including a trapping unit and at least one front stopper, according to some embodiments of the invention.
Figure 3B:
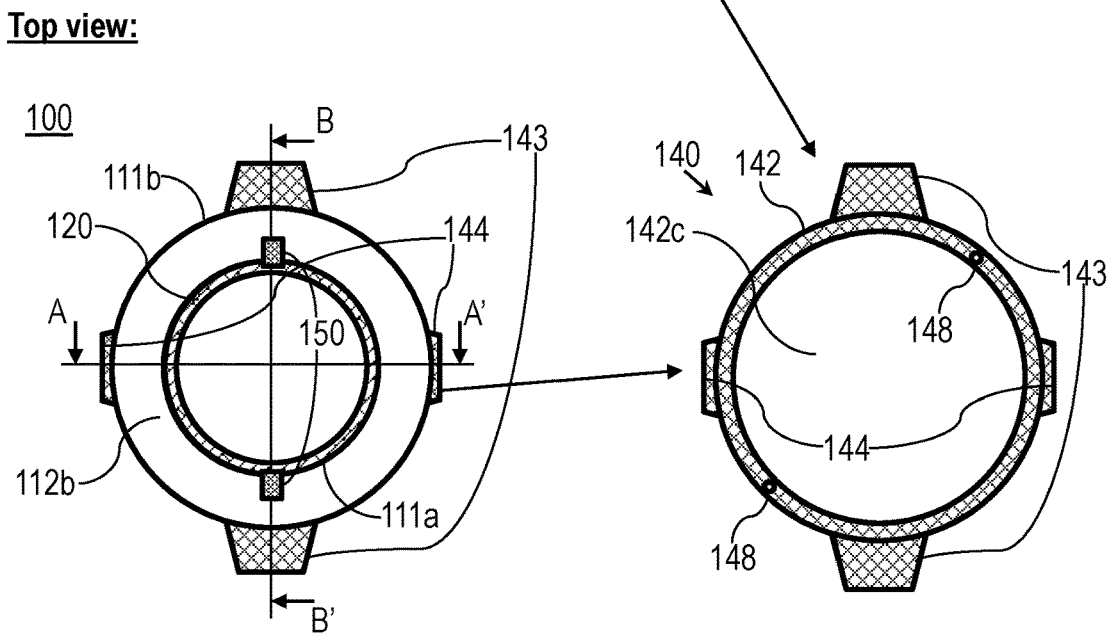
Figure 3C:
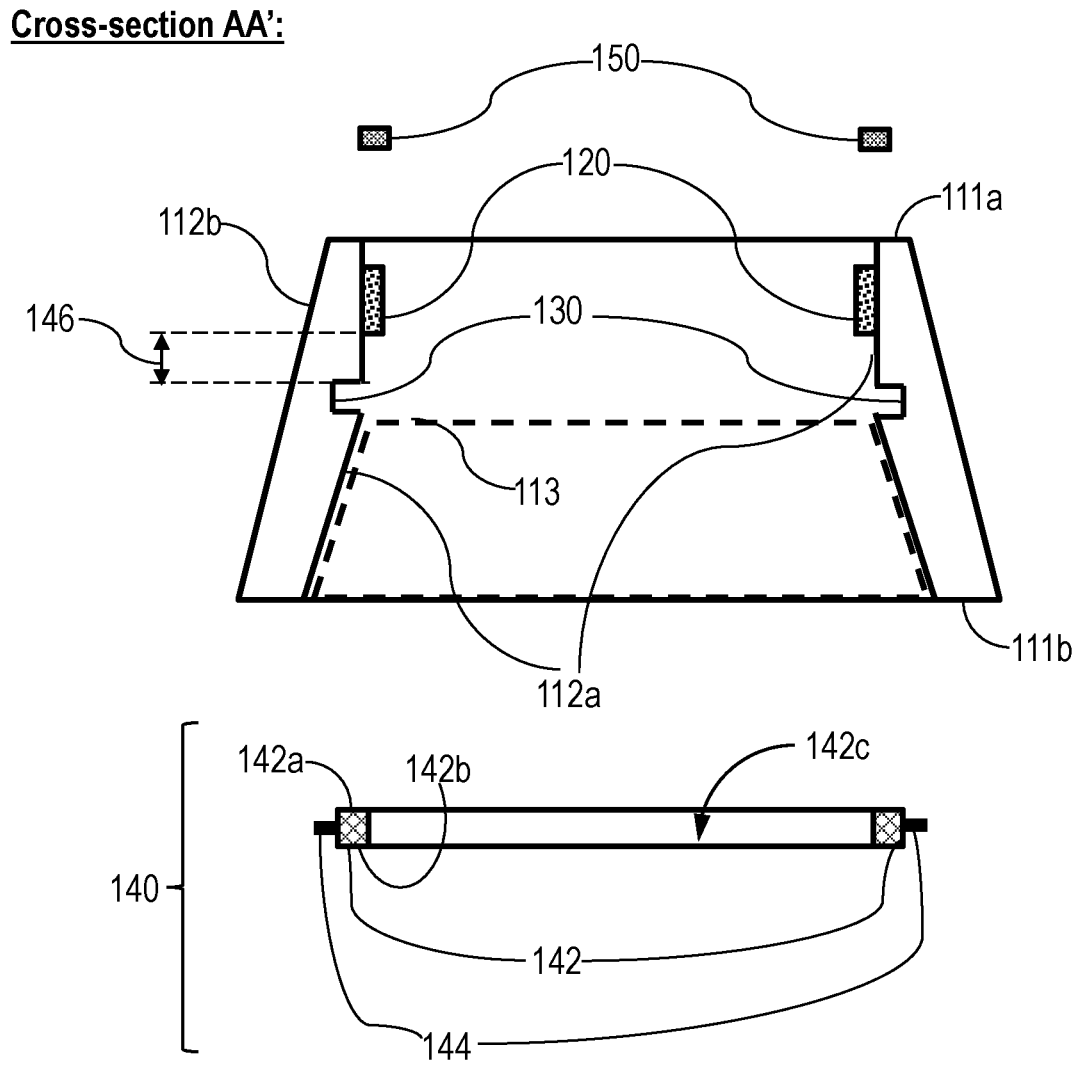
Figure 3D:
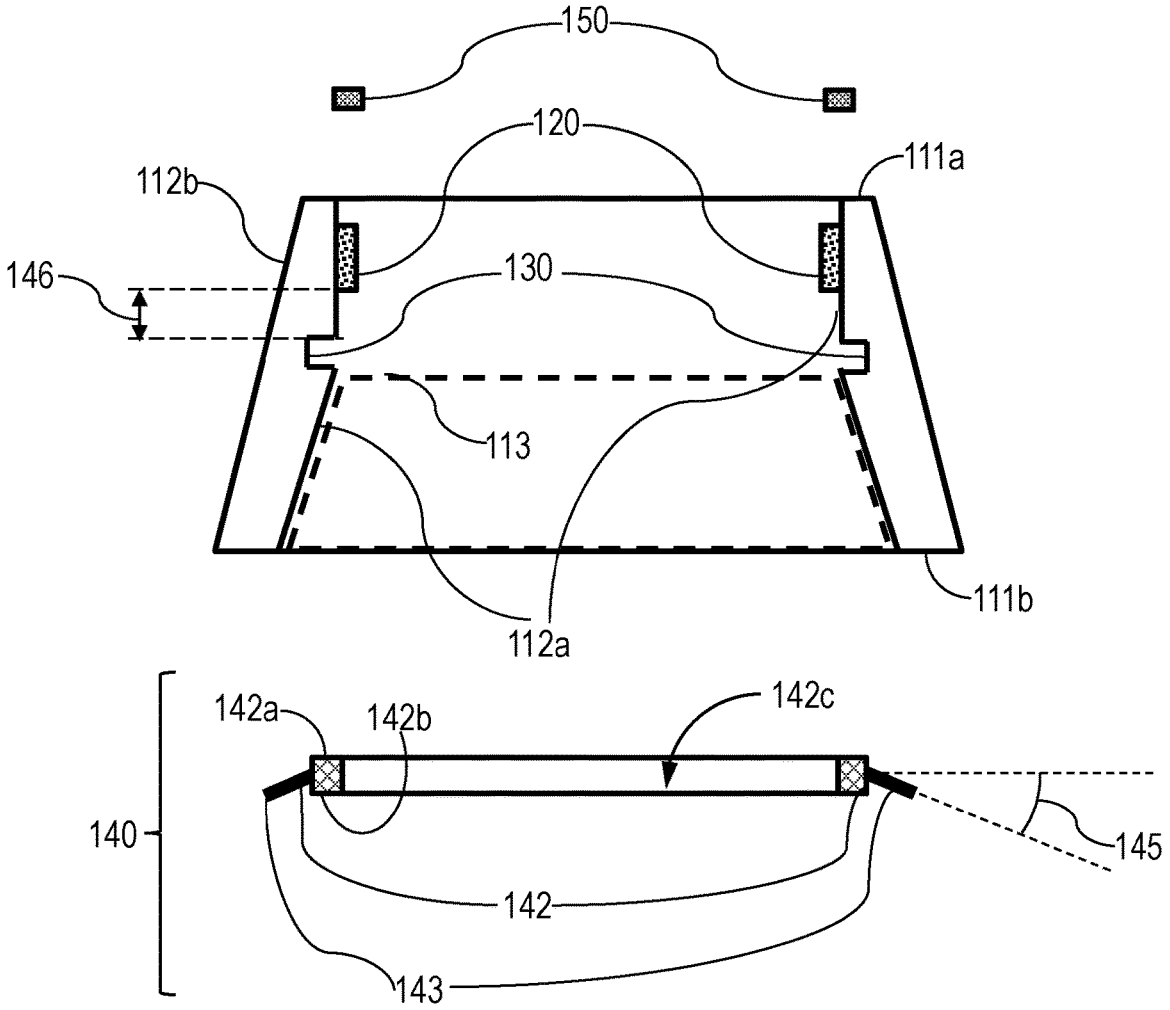
Figure 3F:
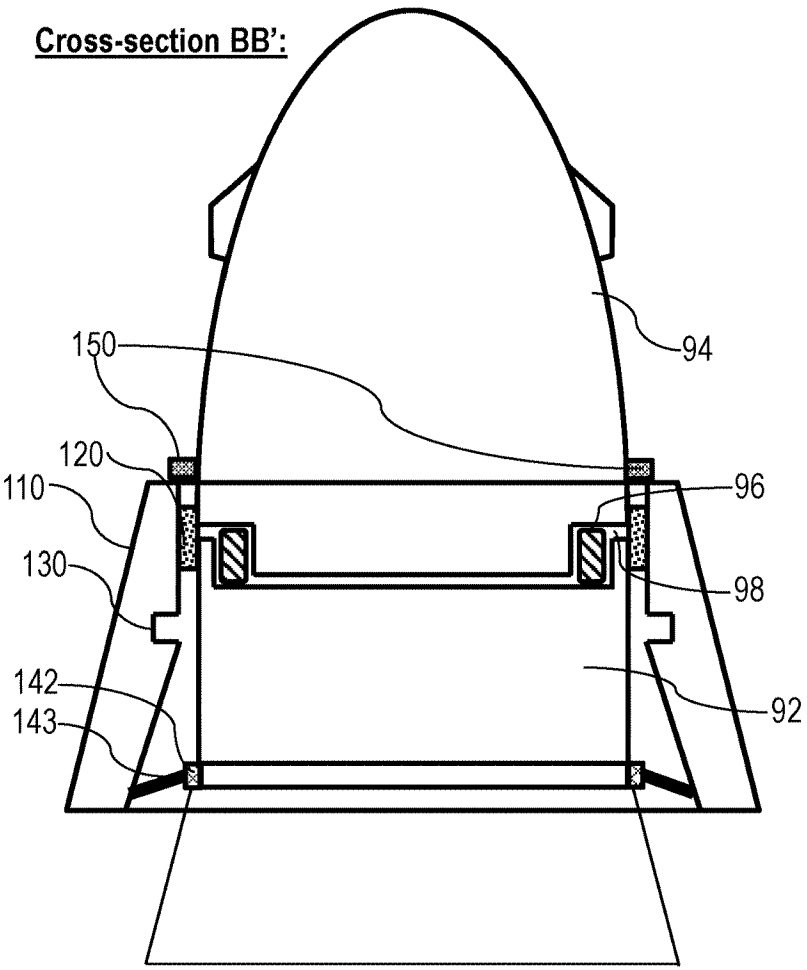
FIGS. 3E and 3F are schematic illustrations of a projectile guiding kit and a device for sealing the projectile guiding kit and including a trapping unit and at least one front stopper, according to some embodiments of the invention.
Figure 3E:
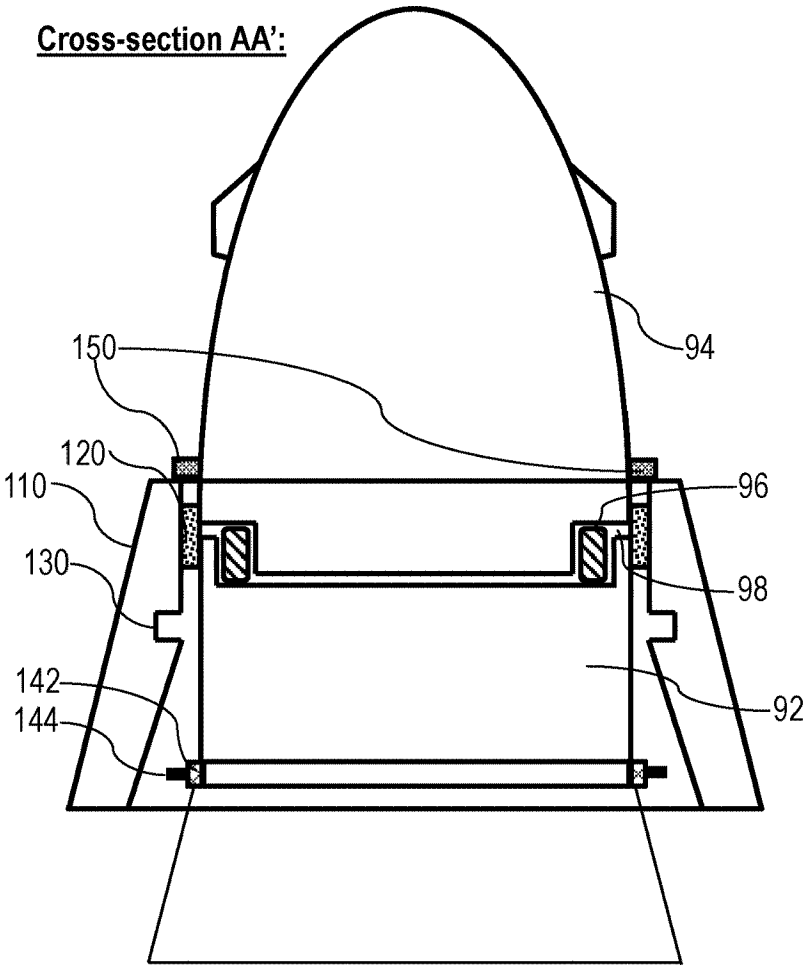
Figure 3G:
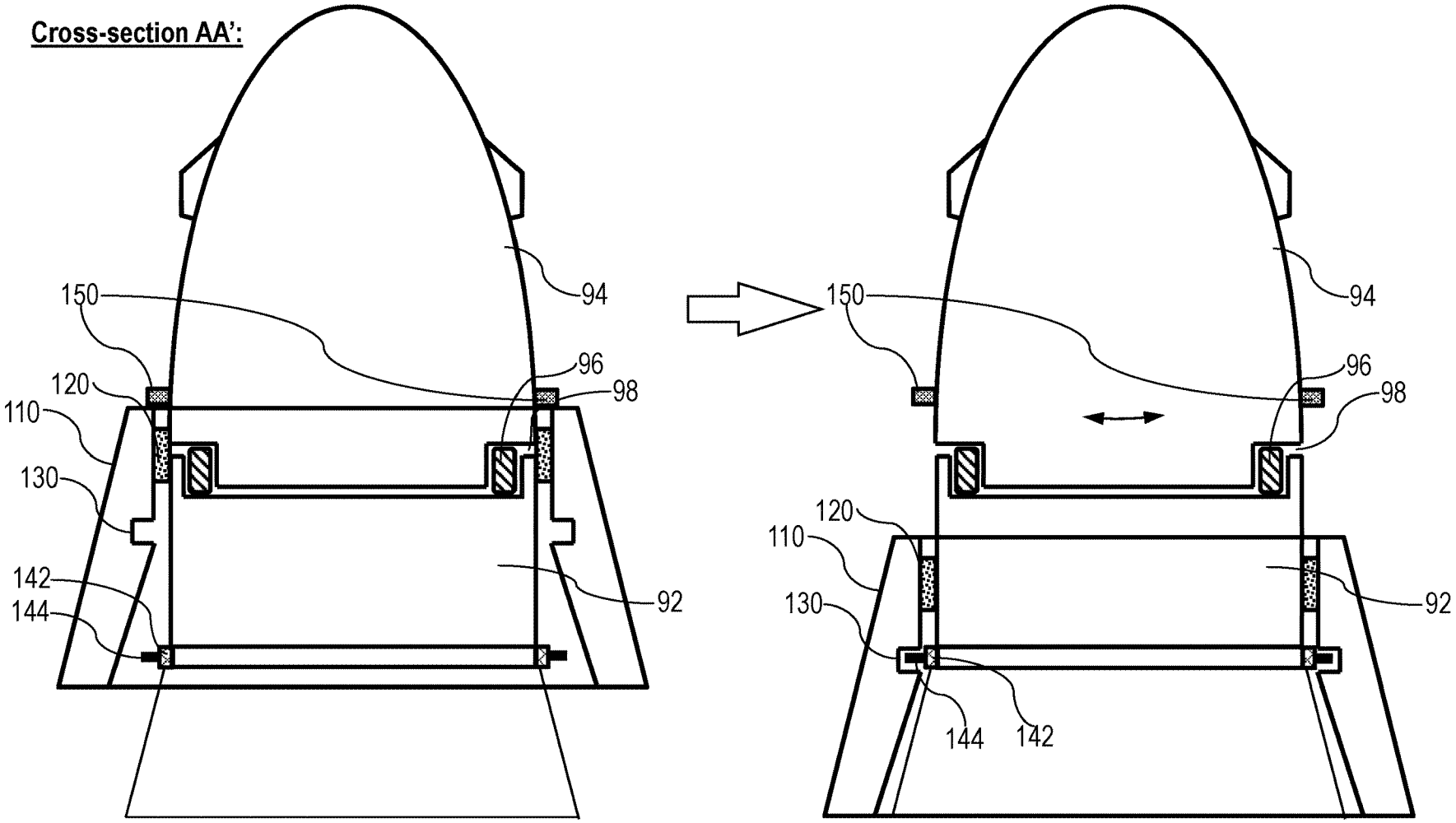
FIG. 3G is a schematic illustration of a projectile guiding kit and a device for sealing the projectile guiding kit and including a trapping unit and at least one front stopper, prior to and after firing of a projectile, according to some embodiments of the invention.

FIG. 3A shows a side view, FIG. 3B shows a top view, FIG. 3C shows a first cross-sectional view, and FIG. 3D shows a second cross-sectional view of device 100. FIGS. 3E and 3F show the first cross-sectional view and the second cross-sectional view, respectively, of device 100 and of projectile guiding kit 90, according to some embodiments of the invention. FIG. 3G shows the first cross-sectional view of device 100 and of projectile guiding kit 90 prior to and upon firing of projectile 80.

According to various embodiments, device 100 may include a trapping unit 140 and/or at least one front stopper 150.

According to some embodiments, trapping unit 140 may be adapted to prevent unintentional sliding of annular body 110 towards rear unit 92 of guiding kit 90 prior to firing of projectile 80. This is in addition to the friction forces between flexible ring-shape strip 120 and the respective portions of rear unit 92 and front unit 94 of guiding kit 90 (e.g., as described above with respect to FIGS. 2A-2F).

In some embodiments, trapping unit 140 may be adapted to lock annular body 110 upon sliding of annular body 110 towards rear unit 92 of guiding kit 90, upon firing of projectile 90. In this manner, gap 98 between rear unit 92 and front unit 94 of guiding kit 90 may be kept uncovered upon firing of projectile 80, independently of aerodynamic forces that are applied on annular body 110 during the flight of projectile 80.

According to some embodiments, trapping unit 140 includes an annular (or substantially annular) trapping plate 142, one or more first protrusions 143, and one or more second protrusions 144.

Annular plate 142 may have a front side 142*a* and a rear side 142*b* and a central opening 142*c* (e.g., as shown in FIGS. 3A and 3B). Annular plate 142 may be adapted to be connected to rear unit 92 of guiding kit 90. For example, annular plate 142 may be adapted to be connected to rear end 92*a* of rear unit 92 while yet enabling connection of rear end 92*a* of rear unit 92 to front end 82 of projectile 80 (e.g., as shown in FIGS. 3E and 3F). In some embodiments, annular plate 142 may include one or more holes 148 to enable connection of annular plate 142 to rear unit 92 of guiding kit 90 (e.g., as shown in FIG. 3B).

First protrusion(s) 143 may generally protrude outwards from annular plate 142 (e.g., as shown in FIGS. 3A, 3B, 3D and 3F). In some embodiments, first protrusion(s) 143 are inclined at a predetermined angle 145 with respect to a plane of annular plate 142 in a direction extending from front side 142*a* to rear side 142*b* of annular plate 142 (e.g., as shown in FIGS. 3A and 3D). Angle 145 is indicated in FIG. 3D only (for sake of clarity). In some embodiments, angle 145 ranges between 20°-35°.

First protrusion(s) 143 may be arranged to support annular body 110 (or at least rear end 111*b* of annular body 110) prior to firing of projectile 80 (e.g., as shown in FIG. 3F), while enabling sliding of annular body 110 towards rear unit 92 of guiding kit when subjected to the predetermined longitudinal acceleration and/or the predetermined longitudinal force.

Second protrusion(s) 144 may generally protrude outwards from annular plate 142 (e.g., as shown in FIGS. 3A, 3B and 3C). In the embodiments of FIGS. 3A, 3B and 3C, annular body 110 of device 100 may further include an indent 130 (e.g. a circular indent) made on inner side 112*a* of annular body 110, between ring-shaped strip 120 and rear end 111*b* of annular body 110 and at a predetermined distance 146 with respect to ring-shaped strip 120 (e.g., as shown in FIGS. 3A-3C). Distance 146 is indicated in FIG. 3D only (for sake of clarity). In some embodiments, indent 130 is made along at least a portion of the circumference of inner side 112*a* of annular body 110.

Annular plate 142 and/or first protrusion(s) 143 and/or second protrusion(s) 144 may be made of, for example, flexible/bendable metal. The mechanical parameters of the flexible/bendable metal may be determined to enable mostly plastic (e.g., irreversible) bending of first protrusion(s) 143 and/or of second protrusion(s) 144 when, for example, a force applied thereon by annular body 110, exceeds a predetermined force value (e.g., force of 100 N, for example upon firing of projectile 80), while yet enabling a desired measure of elastic deformation of first protrusion(s) 143 and/or of second protrusion(s) 144 upon the plastic bending thereof.

Upon firing of projectile 80, annular body 110 of device 100 may slide towards rear unit 92 of guiding kit 90, while bending first protrusion(s) 143 and/or second protrusion(s) 144 and enabling second protrusion(s) 144 to enter into indent 130 of annular body 110, thereby locking annular body 110 with respect to rear unit 92. The distance between indent 130 and ring-shaped strip 120 may be determined based on dimensions of annular body 110 and/or of rear unit 92 to ensure that when annular body 110 is locked with respect to rear unit 92 by second protrusion(s) 144 of annular plate 142, gap 98 remains uncovered (e.g., as shown in FIG. 3G).

According to some embodiments, front stopper(s) 150 may be adapted to be connected to front unit 94 of guiding kit 90 (e.g., as shown in FIGS. 3A-3G). Front stopper(s) 150 may prevent unintended sliding of annular body 110 of device 100 towards front unit 94 of guiding kit 90.

According to some embodiments, relative positions of annular plate 142/first protrusion(s) 143 of trapping unit 140 with respect to front stopper(s) 150 may be determined so as to ensure that ring-like strip 120 attached to annular body 110 tightly seals gap 98 between rear unit 92 and front unit 94 of guiding kit 90 prior to firing of projectile 80.

It is noted that, for simplicity and clarity of illustration, elements shown in FIGS. 3A-3G have not necessarily been drawn to scale. It is further noted that the shape and dimensions of device 100 and/or annular body 110 are determined to ensure that device 100 and/or annular body 110 does not affect (or substantially does not affect) the aerodynamic forces applied on and/or the aerodynamic parameters of guiding kit 90 and/or on projectile 80 during flight of projectile 80.

Figure 4A:
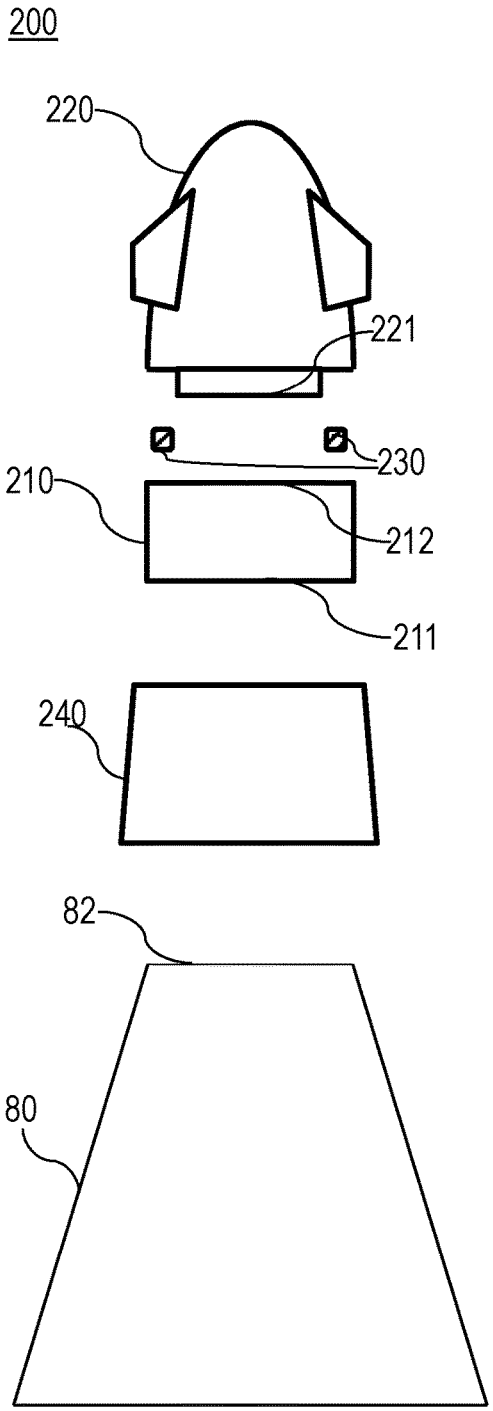
FIGS. 4A and 4B are schematic illustrations of a projectile guiding kit for a projectile, according to some embodiments of the invention.
Figure 4B:
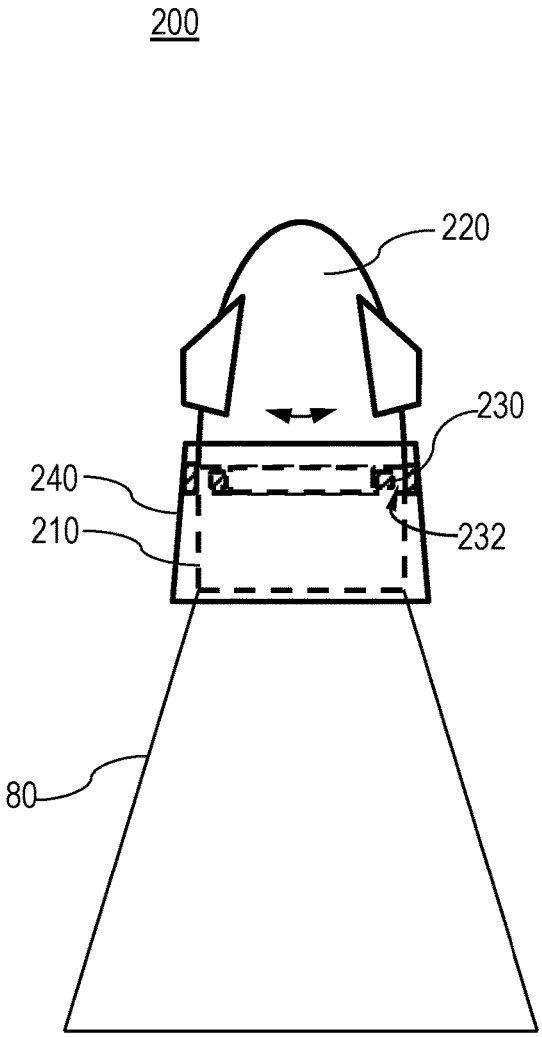

Reference is now made to FIGS. 4A and 4B, which are schematic illustrations of a projectile guiding kit 200 for a projectile 80, according to some embodiments of the invention. FIG. 4A shows and exploded side view and FIG. 4B shows an assembled side vide of guiding kit 200.

According to some embodiments, projectile guiding kit 200 includes a rear unit 210 adapted to be connected at its rear end 211 to a front end 82 of a projectile 80 and a front unit 220 rotatably connected at its rear end 221 to a front end 212 of rear unit 210. Projectile guiding kit 200 may have one or more bearings 230 positioned within, or proximal to, a gap 232 between rear unit 210 and front unit 220 to enable the uninterrupted rotation of front unit 220 with respect to rear unit 210.

According to some embodiments, projectile guiding kit 200 includes a device 240 for sealing projectile guiding kit 200. Device 240 may be similar to device 100 described above with respect to FIGS. 2A, 2B, 2C, 2D, 2E and 2F and FIGS. 3A, 3B, 3C, 3D, 3E, 3F and 3G.

Advantageously, the disclosed device for sealing projectile guiding kits need not be removed from the guiding kit connected to the projectile prior to firing of the projectile. For example, the projectile may be fed into a firing chamber of a weapon without detaching/releasing the device from the guiding kit. Accordingly, the disclosed device may seal sensitive elements of the projectile guiding kit (such as bearing(s) between the rear unit and the front unit thereof) all the way up to actual firing of the projectile. Furthermore, the disclosed device may save time and reduce personnel's effort required to prepare the projectile for firing and/or enable usage of the guiding kit with projectile for automatic weapons. This in contrast to current covering for the projectile guiding kit that has to be manually released/detached from the guiding kit prior to feeding the projectile into the weapon's firing chamber.

In the above description, an embodiment is an example or implementation of the invention. The various appearances of "one embodiment", "an embodiment", "certain embodiments" or "some embodiments" do not necessarily all refer to the same embodiments. Although various features of the invention can be described in the context of a single embodiment, the features can also be provided separately or in any suitable combination. Conversely, although the invention can be described herein in the context of separate embodiments for clarity, the invention can also be implemented in a single embodiment. Certain embodiments of the invention can include features from different embodiments disclosed above, and certain embodiments can incorporate elements from other embodiments disclosed above. The disclosure of elements of the invention in the context of a specific embodiment is not to be taken as limiting their use in the specific embodiment alone. Furthermore, it is to be understood that the invention can be carried out or practiced in various ways and that the invention can be implemented in certain embodiments other than the ones outlined in the description above.

The invention is not limited to those diagrams or to the corresponding descriptions. Meanings of technical and scientific terms used herein are to be commonly understood as by one of ordinary skill in the art to which the invention belongs, unless otherwise defined. While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A device for sealing a projectile guiding kit having a rear unit adapted to be connected at its rear end to a front end of a projectile and a front unit rotatably connectable at its rear end to a front end of the rear unit, the device comprising:

an annular body adapted to envelope at least a front portion of the rear unit and at least a rear portion of the front unit of the guiding kit; and a flexible ring-shaped strip attached to an inner side and close to a front end of the annular body, the ring-shaped strip being adapted to seal a gap between the rear unit and the front unit of the guiding kit at a connection region therebetween;

wherein the annular body is adapted to slide towards the rear unit of the guiding kit when subjected to a longitudinal acceleration that exceeds a predetermined acceleration value, thereby uncovering the gap and enabling uninterrupted rotation of the front unit with respect to the rear unit of the guiding kit.

2. The device of claim 1, further comprising a trapping unit adapted to be connected to the rear unit of the guiding kit and adapted to at least one of:

support at least a rear end of the annular body to prevent unintended sliding of the annular body towards the rear unit of the guiding kit; and lock the annular body of the device with respect to the rear unit of the guiding kit upon sliding of the annular body thereto.

3. The device of claim 2, wherein the trapping unit comprises an annular plate adapted to be connected to the rear end of the rear unit of the guiding kit and comprising at least one first protrusion that protrudes outwards from the annular plate and is arranged to support the rear end of the annular body and to prevent the unintended sliding of the annular body.

4. The device of claim 2:

wherein the trapping unit comprises an annular plate adapted to be connected to the rear end of the rear unit of the guiding kit and comprising at least one second protrusion that protrudes outwards from the annular plate, wherein the annular body comprises an indent along at least a portion of a circumference of the inner side of the annular body between the ring-shaped strip and the rear end of the annular body, and wherein the at least one second protrusion of the trapping unit is adapted to enter into the ident of the annular body to thereby lock the annular body with respect to the rear unit of the guiding kit upon sliding of the annular body thereto.

5. The device of claim 1, further comprising at least one front stopper adapted to be connected to the front unit of the guiding kit and adapted to prevent unintentional sliding of the annular body towards the front unit of the guiding kit.

6. The device of claim 1, wherein a portion of the inner side of the annular body that is adjacent to a rear end of the annular body is tapered in a direction extending from the rear end to the front end of the annular body and is adapted to rest on corresponding portion of a projectile upon sliding of the annular body thereto.

7. The device of claim 1, wherein an outer side of the annular body is tapered in a direction extending from a rear end to the front end of the annular body.

8. A projectile guiding kit adapted to be connected to a projectile, the kit comprising:

a rear unit adapted to be connected at its rear end to a front end of the projectile;

a front unit rotatably connected at its rear end to a front end of the rear unit;

an annular body adapted to envelope at least a portion of the rear unit and at least a portion of the front unit; and a flexible ring-shaped strip attached to an inner side and close to a front end of the annular body, the ring-shaped strip being adapted to seal a gap between the rear unit and the front unit at a connection region therebetween;

wherein the annular body is adapted to slide towards the rear unit of the guiding kit when subjected to a longitudinal acceleration that exceeds a predetermined acceleration value, thereby uncovering the gap and enabling uninterrupted rotation of the front unit with respect to the rear unit.

9. The projectile guiding kit of claim 8, further comprising a trapping unit adapted to be connected to the rear unit and adapted to at least one of:

support at least a rear end of the annular body to prevent unintended sliding of the annular body towards the rear unit; and lock the annular body with respect to the rear unit upon sliding of the annular body thereto.

10. The projectile guiding kit of claim 9, wherein the trapping unit comprises an annular plate adapted to be connected to the rear end of the rear unit of the guiding kit and comprising at least one first protrusion that protrudes outwards from the annular plate and is arranged to support the rear end of the annular body and to prevent the unintended sliding of the annular body.

11. The projectile guiding kit of claim 9:

wherein the trapping unit comprises an annular plate adapted to be connected to the rear end of the rear unit and comprising at least one second protrusion that protrudes outwards from the annular plate, wherein the annular body comprises an indent along at least a portion of a circumference of the inner side of the annular body between the ring-shaped strip and the rear end of the annular body, and wherein the at least one second protrusion of the trapping unit is adapted to enter into the ident of the annular body to thereby lock the annular body with respect to the rear unit upon sliding of the annular body thereto.

12. The projectile guiding kit of claim 8, wherein the front unit comprises at least one front stopper adapted to prevent unintentional sliding of the annular body towards the front unit.

13. The projectile guiding kit of claim 8, wherein a portion of the inner side of the annular body that is adjacent to a rear end of the annular body is tapered in a direction extending from the rear end to the front end of the annular body and is adapted to rest on a corresponding portion of a projectile upon sliding of the annular body thereto.

14. The device of claim 8, wherein an outer side of the annular body is tapered in a direction extending from a rear end to the front end of the annular body.

* * * * *